United States Patent [19]

Hoshi et al.

[11] Patent Number: 4,770,334

[45] Date of Patent: Sep. 13, 1988

[54] STAPLER APPARATUS

[75] Inventors: Akimitsu Hoshi, Yokohama; Masakazu Hiroi, Tokyo, both of Japan

[73] Assignee: Canon Kabushiki Kaisha, Tokyo, Japan

[21] Appl. No.: 909,936

[22] Filed: Sep. 22, 1986

[30] Foreign Application Priority Data

Sep. 24, 1985 [JP] Japan ..... 60-210406

[51] Int. Cl.[4] ..... B25C 5/08

[52] U.S. Cl. ..... 227/85; 227/120; 227/121

[58] Field of Search ..... 227/85, 120, 121

[56] References Cited

U.S. PATENT DOCUMENTS

| | | | |
|---|---|---|---|
| 2,095,659 | 10/1937 | Cavanagh | 227/121 |
| 2,107,522 | 2/1938 | Cavanagh | 227/121 |
| 4,588,121 | 5/1986 | Olesen | 227/120 |

*Primary Examiner*—Paul A. Bell

*Attorney, Agent, or Firm*—Fitzpatrick, Cella, Harper & Scinto

[57] ABSTRACT

A stapler apparatus which is provided with a needle feeding mechanism for feeding needles continuously formed in a band-like shape in succession to a driving-in station and which can prevent the band-like needles from moving backward and reliably feed the needles forwardly even if a backwardly moving force acts on the band-like needles in a state in which the leading needle is not bent.

30 Claims, 9 Drawing Sheets

STAPLER APPARATUS

BACKGROUND OF THE INVENTION

1. Field of the Invention

This invention relates to a stapler apparatus having a needle staple mechanism for feeding staple blanks continuously formed in succession to a driving-in station.

2. Related Background Art

Heretofore, a staple blank feeding apparatus as shown in FIG. 8 of the accompanying drawings wherein staples are fed one by one has been prepared for the next staple blank feeding by moving a feeding pawl 37 in the direction opposite to the feeding direction of needles 45 in the normal state as shown in FIG. 11 of the accompanying drawings. While the leading staple blank 46 bent as shown in FIG. 9(*b*) of the accompanying drawings is preventing the backward movement of the staple blanks. This will hereinafter be described in detail with reference to FIG. 11. The leading staple blank 46 has its central portion held by a holding block 35. At this time, the leading staple blank 46 is not yet bent, but is in its state shown in FIG. 9(*a*) of the accompanying drawings. Subsequently, by pushing a roller 23 downwardly, a plate spring member 25 and a bending block 41 are moved downwardly, and the bending block 41 strikes against the opposite ends of the leading staple blank 46 and bends it as shown in FIG. 9(*b*). When the roller 23 is further pushed in, the projected portion 47 of the bending block 41 distorts a staple blank feeding member 36 as indicated by dotted line. Thereupon, the staple blank feeding pawl 37 moves in the direction opposite to the staple blank feeding direction. However, by this time, the leading staple blank 46 has already been bent as shown in FIG. 9(*b*) and is caught by a cutting member 40. Therefore, the staple blanks 45 do not go back and only the feeding pawl 37 moves in the opposite direction and can become ready for the next staple blank feeding. Thereafter, when the roller 23 is further moved downwardly, the block pushing pawl 42 of the plate spring member 25 comes off the bending block 41 and only the fore end 43 of the plate spring comes down. Then, the fore end 43 of the plate spring cooperates with a cutting member 40 to cut the leading staple blank 46 off the succeeding staple blank 45 while pushing aside the holding block 35 into the state indicated by dot-and-dash line. The leading staple blank 46 is driven into a bundle of paper and sumultaneously therewith, it bends the leading staple blank as shown in FIG. 9(*c*) of the accompanying drawings, thereby binding the bundle of paper. When the leading needle has been completely driven into the bundle of paper, the roller 23 is returned upwardly and the projected portion 47 comes off the staple blank feeding member 36, and the feeding pawl 37 returns to its original position, i.e., the position indicated by solid line. At this time, the staple blanks 45 move forward. By the above-described operation, staple blank feeding is reliably effected in the normal state.

However, it is often the case that the fore end of the staple blanks 45 does not reach the bending station B when a staple blank cartridge 28 has been mounted. The leading staple blank 46 is not bent and is not caught by the cutting member 40 and therefore, the staple blanks only reciprocally move with the reciprocal movement of the feeding pawl 37 and do not move forward. Thus, the needles do not arrive at the bending station B.

SUMMARY OF THE INVENTION

The present invention has been made to solve the above-noted problems peculiar to the prior art and the gist thereof resides in a staple apparatus having driving-in means for bending staple blanks continuously formed in a band-like shape in succession from the leading one and driving the staple blanks into a sheet material. Staple blank feeding means feed said staple blanks toward said driving-in means, and backward movement preventing means permits the movement of said staple blanks in a forward direction toward said driving-in means and prevents the movement of said staple blanks in a reverse direction opposite to said forward direction.

DESCRIPTION OF THE PREFERRED EMBODIMENTS

Figure 1:
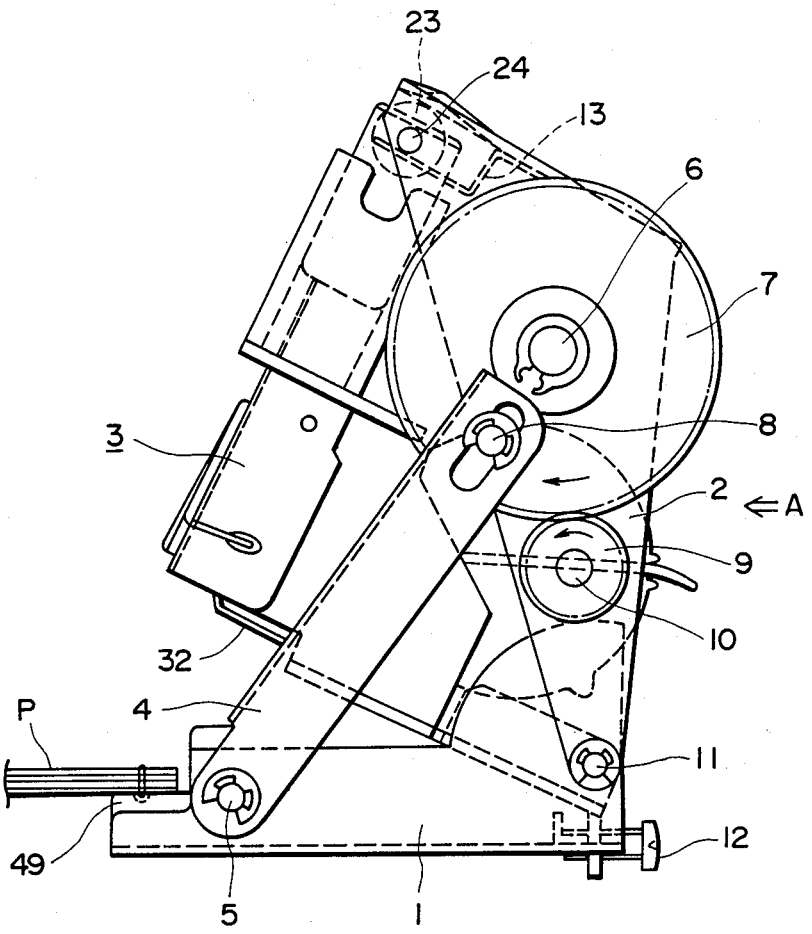
FIGS. 1 and 2 are side views of a stapler apparatus to which the present invention is applicable.
Figure 2:
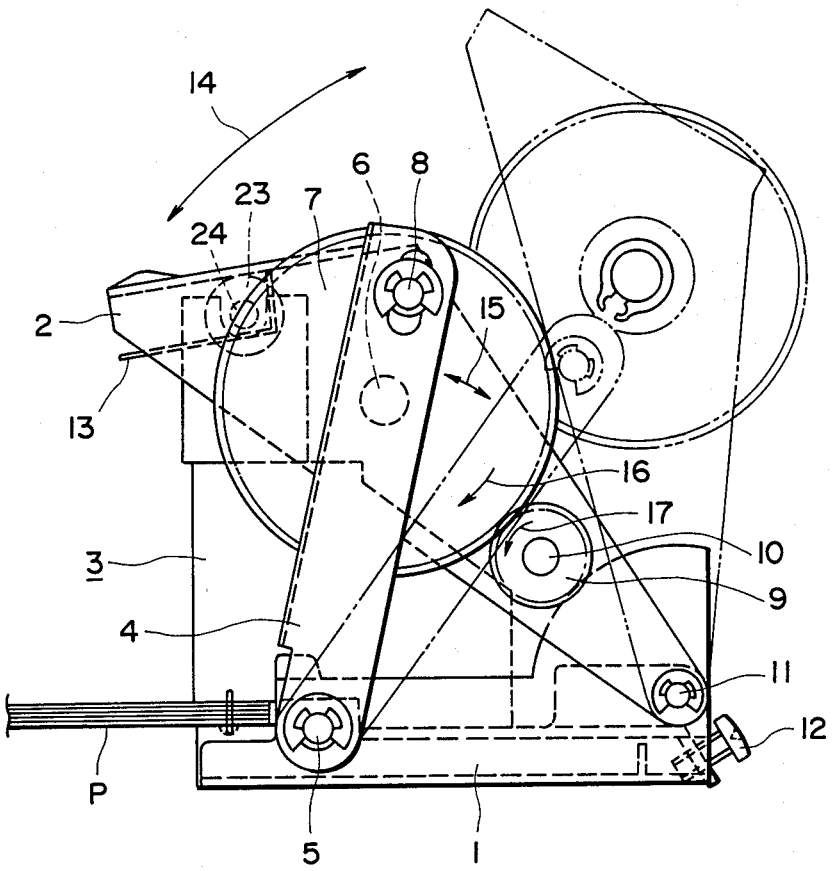
Figure 3:
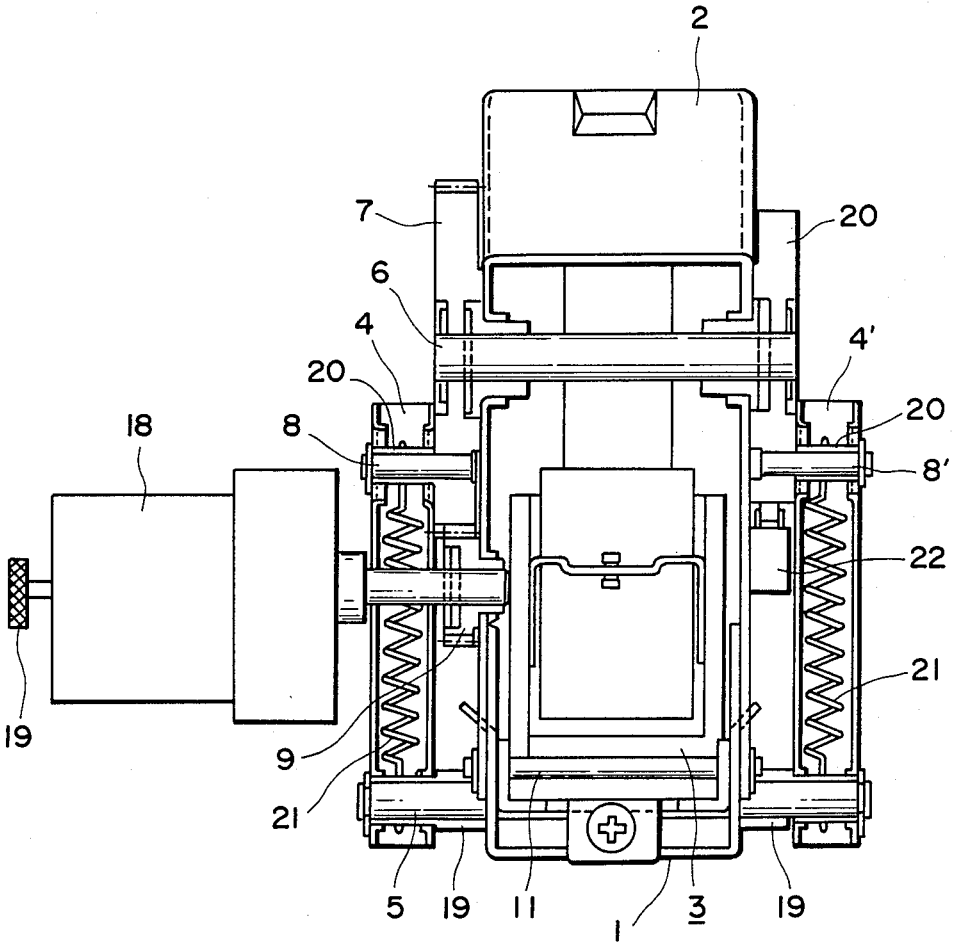
FIG. 3 is a front view of the stapler apparatus.

In FIGS. 1 and 3, reference numeral 1 designates a bed for supporting the entire stapler apparatus. The bed 1 is fixed. An anvil 49 for bending staple blanks is mounted on the bed 1. Reference numeral 2 denotes a rockable frame mounted on the bed 1 through a pivot shaft 11. As shown in FIG. 3, a motor 18, a motor gear (pinion) 9, a crank gear 7, a crank shaft 6, a crank plate 20 and a microswitch 22 are mounted on the rockable frame 2. Pins 8 and 8' are attached to the crank gear 7 and the crank plate 20, respectively, and are connected to a shaft 5 fixed to the bed 1 through crank arms 4 and 4'. A spring 21 is contained in the crank arm 4 so as to be capable of adjusting the distances between the pins 8, 8' and the shaft 5. This is for permitting any variation in the thickness of a bundle of paper P to be stapled. The motor gear 9 is normally stopped at its position shown in FIG. 1, but by the motor gear 9 being rotated in the direction of arrow 17 as shown in FIG. 2, the crank gear 7 is rotated in the direction of arrow 16, the crank arm 4 rocks in the direction of arrow 15 and the rockable frame 2 rocks in the direction of arrow 14.

The state in which the staple blank has been completely driven in is shown by solid lines in FIG. 2, and by revolving the motor 18, operation is repeated between the positions of FIGS. 1 and 2. Reference numeral 3 denotes a driving-in unit pivotally supported on the bed 1 by means of the shaft 11 so as to be able to bend and drive the staple blank by pushing in a roller 23. The roller 23 rolls while being in contact with the surface of the upper end of the rockable frame 2 rocking as indicated by arrow 14 in FIG. 2, and in accordance with the rocking movement of the driving-in unit 3, the roller 23 bends the staple blank at the leading end in the order of FIGS. 9(*a*), (*b*) and (*c*) and drives it into the bundle of paper P. Reference numeral 13 designates a plate spring secured to the rockable frame 2 and adapted to pull up a shaft 24 fitted in the driving-in unit 3. A screw 12 is for adjusting the amount of pull-up of the unit 3, and controls the amount of rocking movement of the driving-in unit 3 so that when in the position of FIG. 1, the roller 23 is relatively pulled out by a predetermined amount from the driving-in unit 3. The microswitch 22 is mounted so as to be capable of effecting the detection for the crank gear 7 to stop at a predetermined position each time it makes one full rotation. This is accomplished by detecting a cut-away provided in the crank plate 20.

FIGS. 4 to 7 show the driving-in unit 3 and the staple blank bending and driving-in operations are as described previously.

Description will now be made of a mechanism for preventing the staple blanks 45 from going back.

Figure 4:
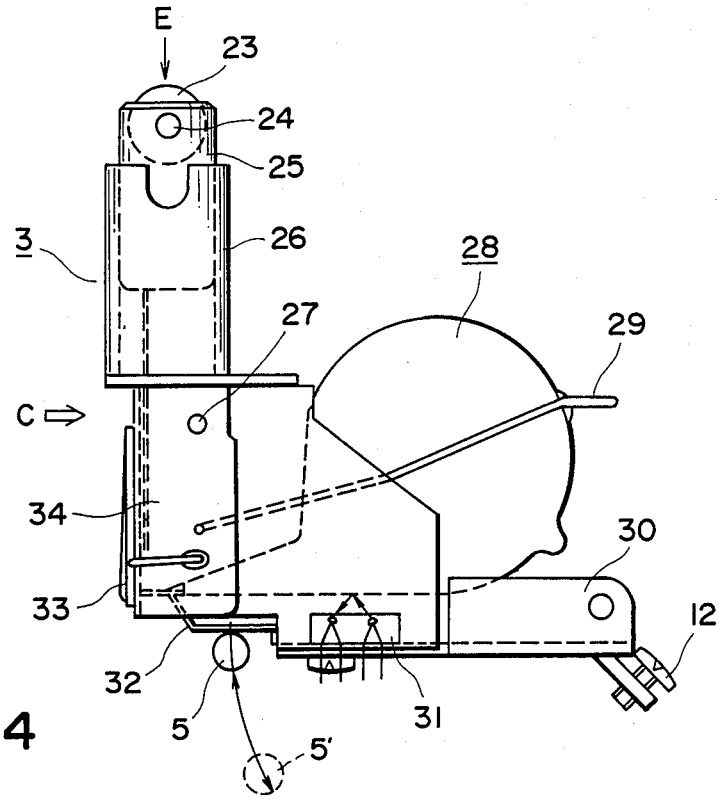
FIG. 4 is a side view of a driving-in unit.
Figure 5:
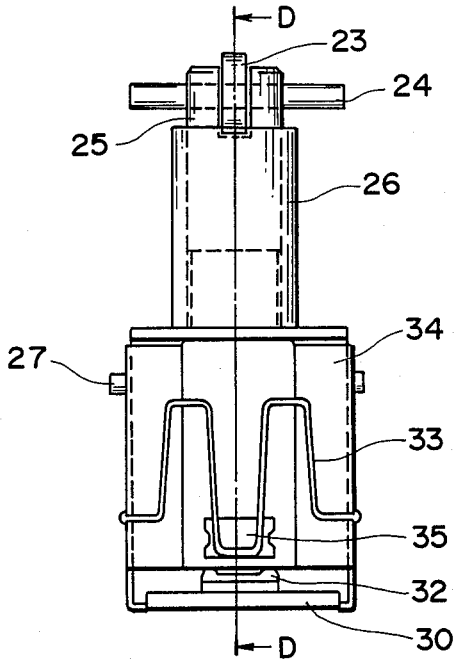
FIG. 5 is a front view of the driving-in unit.
Figure 6:
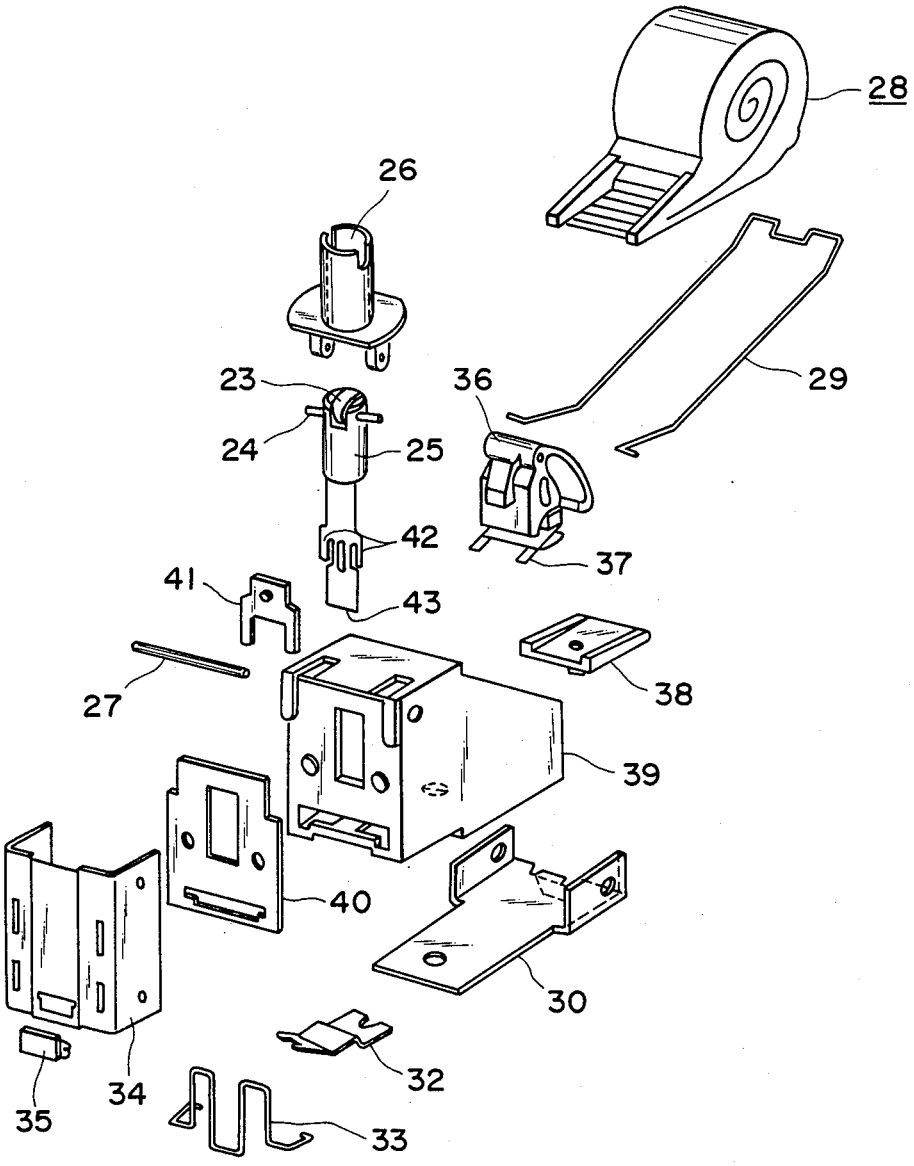
FIG. 6 is an exploded perspective view of the driving-in unit.
Figure 7:
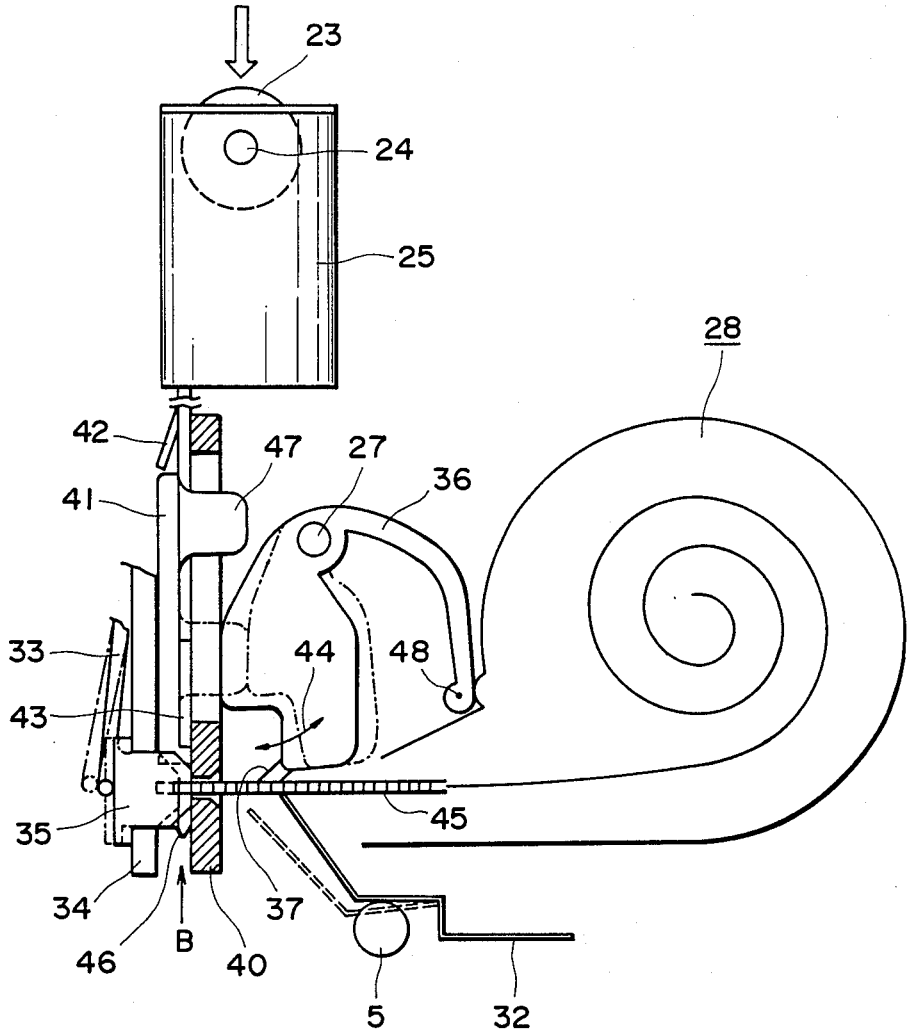
FIG. 7 is a schematic side view showing a first embodiment of the stapler apparatus using the present invention.
Figure 9:
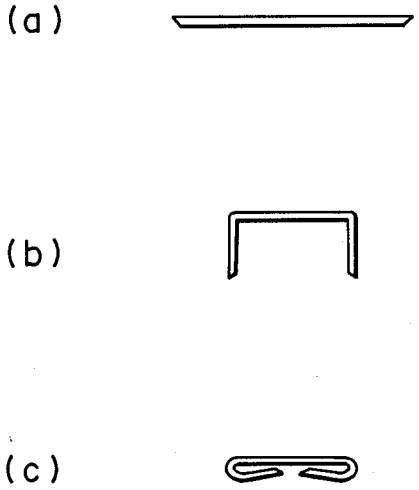
FIGS. 9(*a*), (*b*) and (*c*) illustrate the manner in which a staple blank is bent.

In the position of FIG. 1, a plate spring 32 assumes its shape indicated by dotted line in FIG. 7 and is not in contact with the staple blanks 45. When the motor 18 is then revolved to drive the staple blank in, the rockable frame 2 pushes the roller 23 downwardly, but since a plate spring member 25 is heavier in motion than the rocking movement of the driving-in unit 3, the entire unit 3 first rocks downwardly until it contacts the bundle of paper P. Thus, the plate spring 32 is held down by the shaft 5 which has been relatively moved from a position 5' to a position 5 by the rocking movement of the driving-in unit 3, as shown in FIG. 4, and comes into contact with the underside of the needles 45 as indicated by a solid line in FIG. 7. At this time the backward movement of the staple blanks is controlled when the motor 18 is further revolved, the roller 23 is relatively pushed into the driving-in unit 3 as previously described, and a feed pawl 37 moves in the direction opposite to the staple blank feeding direction. However, the staple blanks 45 are prevented from moving in the opposite direction by the plate spring 32. Therefore, the staple blank 46 at the leading end is bent as shown in FIG. 9(*b*) and even if it is not caught by a cutting member 40, only the feed pawl 37 will move. Next, when the motor 18 is further revolved and the driving-in unit 3 is to be pulled up, the entire unit 3 is first pulled up as previously described. Thus, the plate spring 32 restores its shape indicated by the dotted line in FIG. 7 and separates from the underside of the staple blanks 45. When the driving-in unit 3 is further pulled up, the screw 12 strikes against a stopper and the elevation of the unit 3 is stopped. Thereafter, only the roller 23 is further pulled up by the plate spring 13. At this time, the projected portion 47 separates from a staple blank feeding member 36 as previously described and therefore, moves from its dotted line position to its solid line position. By this time, the plate spring 32 has already separated from the underside of the staple blanks 45 and therefore, the staple blank feeding member 36 can feed the staple blanks 45 without any new load being applied thereto. By the above-described operation being repeated, staple blank feeding can be accomplished more reliably than before even when and after a needle cartridge 28 has been set.

Also, the plate spring 32 is normally separate from the staple blanks and therefore, it does not hamper the putting in and out of the needle cartridge.

Figure 10:
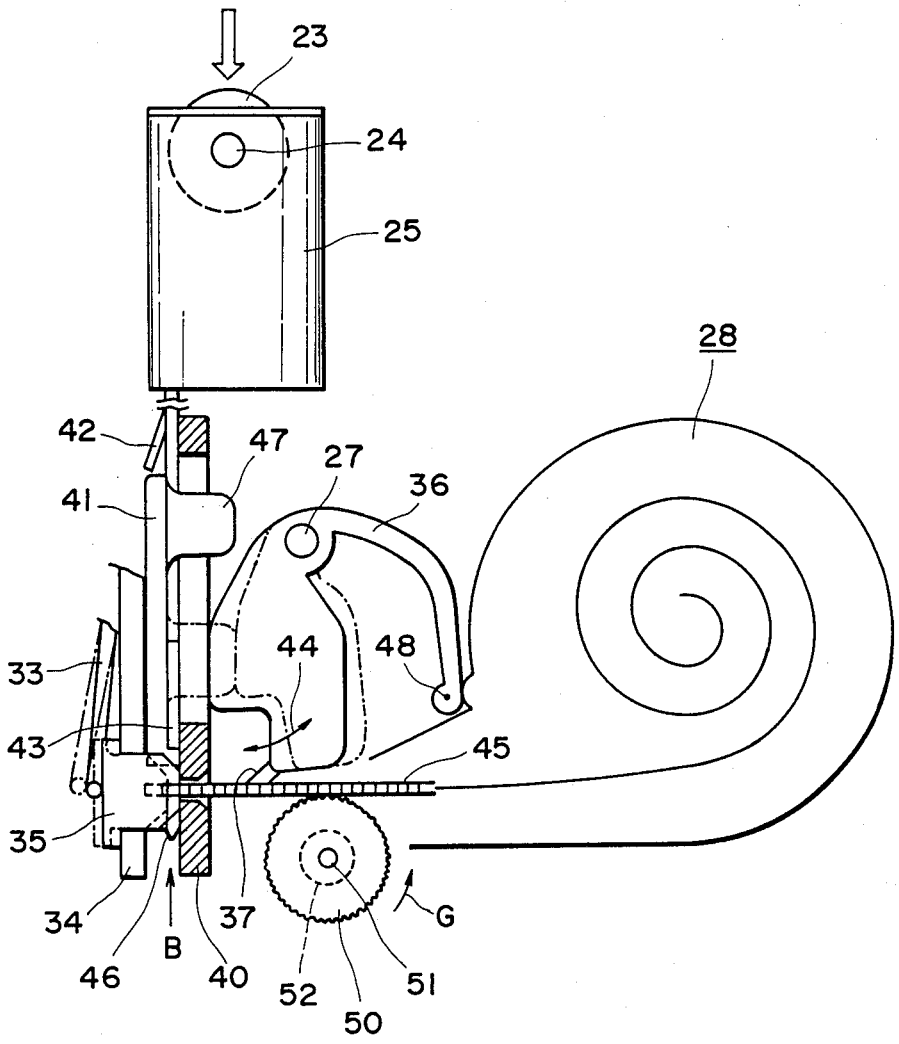
FIG. 10 is a schematic side view showing a second embodiment of the stapler apparatus using the present invention.

FIG. 10 shows a second embodiment of the present invention. A backward movement preventing roller 50 having a finely uneven peripheral surface is supported on a shaft 51 and is normally in contact with the underside of the staple blanks 45. A one-way clutch 52, shown by broken line, is provided between the shaft 51 and the backward movement preventing roller 50, and the backward movement preventing roller 50 is freely rotatable in the direction of arrow G but nonrotatable in the opposite direction. Therefore, the backward movement preventing roller 50 forms no obstacle when the feed pawl 37 feeds the staple blanks 45 in the feeding direction, i.e., toward a bending station B, but it does not permit backward movement of the staple blanks 45 by the action of the one-way clutch when the feed pawl 37 applies a force to the staple blanks 45 in the direction opposite to the feeding direction.

I claim:

1. A stapler apparatus comprising:

driving-in means adapted for driving uniform staples continuously formed in succession from a leading staple into a sheet material;

staple feeding means for feeding the staples in a forward direction toward said driving-in means; and third means for preventing backward movement of the staples, said third means applying a force to the staples to prevent movement of the staples in a backward direction and not applying a force to the staples to permit movement in the forward direction.

2. A stapler apparatus according to claim 1, wherein said third means has a blocking member which is in contact with the staples to apply the force thereto and out of contact with the staples to remove the force therefrom.

3. A stapler apparatus according to claim 2, wherein said blocking member is a plate spring.

4. A stapler apparatus according to claim 2, wherein said blocking member is in contact with an underside of the staples.

5. A stapler apparatus according to claim 3, wherein said rotatable member is in contact with an underside of the staples.

6. A stapler apparatus according to claim 1, wherein said third means has a rotatable member in contact with the staples, the rotatable member rotating following movement of the staples in the forward direction, but preventing the movement of the staples by not rotating when the staples attempt to move in the backward direction.

7. A stapler apparatus according to claim 6, wherein said rotatable member is supported through a one-way clutch.

8. A stapler apparatus according to claim 7, wherein friction projections are provided on a peripheral surface of said rotatable member.

9. A stapler apparatus according to claim 1, wherein said staple feeding means has a staple feeding member for contacting the staples and effecting reciprocal movement thereof.

10. A stapler apparatus according to claim 1, wherein said staple feeding means feeds the staples in synchronized cooperation with said driving-in means.

11. A stapler apparatus according to claim 1, further having a cutting member cooperating with said driving-in means to cut and separate the leading one of the staples.

12. A stapler apparatus comprising driving-in means adapted for driving staple blanks continuously formed in a band-like shape in succession from a leading staple blank into a sheet material;

staple blank feeding means for feeding the band of staple blanks in a forward direction toward said driving-in means; and third means for preventing backward movement of the band of staple blanks, said third means applying a force to the staple blanks to prevent movement of the staple blanks in a backward direction and not applying a force to the staple blanks to permit movement in the forward direction.

13. A stapler apparatus according to claim 12, wherein said third means has a blocking member which is in contact with the staple blanks to apply the force thereto and out of contact with the staple blanks to remove the force therefrom.

14. A stapler apparatus according to claim 13, wherein said blocking member is in contact with an underside of the staple blanks.

15. A stapler apparatus according to claim 12, wherein said blocking member is a plate spring.

16. A stapler apparatus according to claim 12, wherein said third means has a rotatable member in contact with the staple blanks, the rotatable member rotating following movement of the staple blanks in the forward direction, but preventing the movement of the staple blanks by not rotating when the staple blanks attempt to move in the backward direction.

17. A stapler apparatus according to claim 16, wherein said rotatable member is in contact with an underside of the staple blanks.

18. A stapler apparatus according to claim 16, wherein said rotatable member is supported through a one-way clutch.

19. A stapler apparatus according to claim 16, wherein friction projections are provided on a peripheral surface of said rotatable member.

20. A stapler apparatus according to claim 12, wherein said staple blank feeding means has a staple blank feeding member for contacting the staple blanks and effecting reciprocal movement thereof.

21. A stapler apparatus according to claim 12, wherein said staple blank feeding means feeds the staple blanks in synchronized cooperation with said driving-in means.

22. A stapler apparatus according to claim 12, further having a cutting member cooperating with said driving-in means to cut and separate the leading one of the staple blanks.

23. A stapler apparatus according to claim 12, wherein said apparatus further comprises a supporting member having an anvil to bend a staple blank driven by said driving-in means, and a rocking member supporting said driving-in means, said rocking member being pivotally supported by said supporting member in an actuating position wherein said driving-in means moves toward said anvil and in a non-actuating position wherein said driving-in means moves away from said anvil.

24. A stapler apparatus according to claim 23, wherein said third means is in contact with the staple blanks when said rocking member is in said actuating position and is out of contact with the staple blanks when said rocking member is in said non-actuating position.

25. A stapler apparatus comprising: driving-in means adapted for driving staple blanks continuously formed in a band-like shape in succession from a leading staple blank into a sheet material;

staple blank feeding means for feeding a band of staple blanks in a forward direction toward said driving-in means;

third means for preventing backward movement of the band of staple blanks; and releasing means for releasing said third means when the staple blanks are fed in the forward direction.

26. A stapler apparatus according to claim 25, wherein said third means has a blocking member in contact with the staple blanks.

27. A staple apparatus according to claim 26, wherein said blocking member is in contact with an underside of the staple blanks.

28. A stapler apparatus according to claim 26, wherein said blocking member is a plate spring.

29. A stapler apparatus according to claim 25, wherein said apparatus further comprises a supporting member having an anvil to bend a staple blank driven by said driving-in means and a rocking member supporting said driving-in means, said rocking member being pivotally supported by said supporting member in an actuating position wherein said driving-in means moves towards said anvil and in a non-actuating position wherein said driving-in means moves away from said anvil, and said releasing means releases.

30. A stapler apparatus according to claim 25, wherein said staple blank feeding means has a staple blank feeding member for contacting the staple blanks to effect reciprocal movement thereof.

* * * * *

UNITED STATES PATENT AND TRADEMARK OFFICE

CERTIFICATE OF CORRECTION

PATENT NO. : 4,770,334

DATED : September 13, 1988

INVENTOR(S) : Akimitsu Hoshi, et al.

It is certified that error appears in the above-identified patent and that said Letters Patent is hereby corrected as shown below:

COLUMN 1

Figure 8:
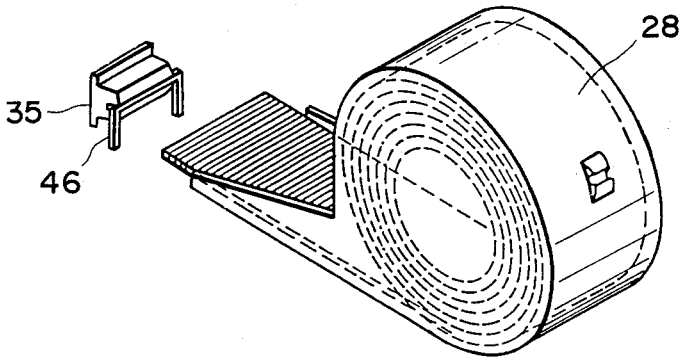
FIG. 8 is a perspective view showing staple blanks used in the stapler apparatus.
Figure 11:
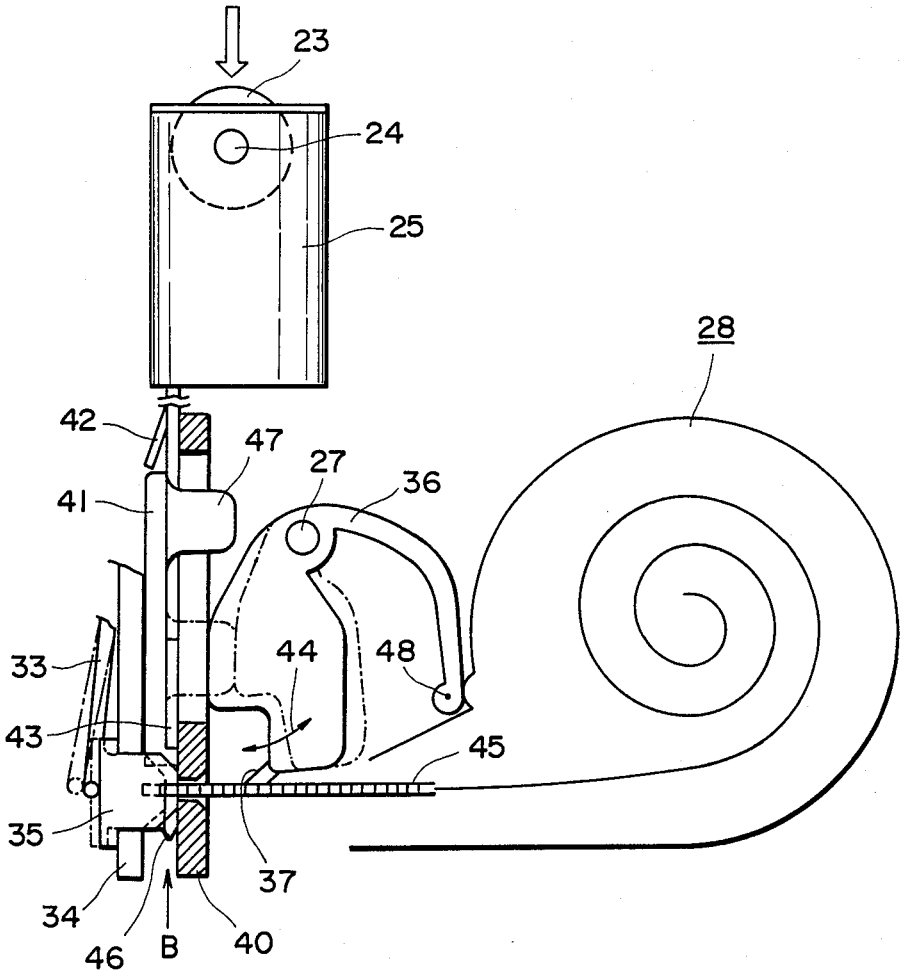
FIG. 11 PRIOR ART
FIG. 11 is a schematic side view showing a stapler apparatus according to the prior art.

Line 7, change "needle staple" to --staple feeding--;

Line 11, change "Fig. 8" to --Fig. 11--;

Line 52, change "needle" to --staple blank--; and

Line 68, change "needles" to --staple blanks--.

COLUMN 3

Line 36, change "needles 45" to --staple blanks 45--; and

Line 67, change "needle" to --staple blank--.

COLUMN 4

Line 3, change "needle" to --staple blank--.

COLUMN 5

Line 25, change "claim 12," to --claim 13,--; and

Line 34, change "claim 16," to --claim 15,--.

UNITED STATES PATENT AND TRADEMARK OFFICE

CERTIFICATE OF CORRECTION

PATENT NO. 4,770,334

DATED September 13, 1988

INVENTOR(S): Akimitsu Hoshi, et al.

It is certified that error appears in the above-identified patent and that said Letters Patent is hereby corrected as shown below:

COLUMN 6

Line 33, change "staple" to --stapler--.

Signed and Sealed this

Thirteenth Day of June, 1989

*Attest:*

DONALD J. QUIGG

*Attesting Officer*

*Commissioner of Patents and Trademarks*